US008295518B2

(12) United States Patent
Alfsmann et al.

(10) Patent No.: US 8,295,518 B2
(45) Date of Patent: Oct. 23, 2012

(54) FILTER BANK SYSTEM HAVING SPECIFIC STOP-BAND ATTENUATION COMPONENTS FOR A HEARING AID

(75) Inventors: Daniel Alfsmann, Bochum (DE); Heinz Goeckler, Backnang (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 365 days.

(21) Appl. No.: 12/623,590

(22) Filed: Nov. 23, 2009

(65) Prior Publication Data

US 2010/0128910 A1 May 27, 2010

(30) Foreign Application Priority Data

Nov. 21, 2008 (DE) ..... 10 2008 058 496

(51) Int. Cl.
*H04R 25/00* (2006.01)

(52) U.S. Cl. ..... 381/317; 381/318

(58) Field of Classification Search ..... 381/317, 381/68.4, 320, 106, 107, 316, 318; 704/201, 704/225

See application file for complete search history.

(56) References Cited

U.S. PATENT DOCUMENTS 5,488,668 A * 1/1996 Waldhauer ..... 381/320
6,236,731 B1 * 5/2001 Brennan et al. ..... 381/316
2006/0291681 A1 * 12/2006 Klinkby et al. ..... 381/318
2008/0010061 A1 * 1/2008 Kjorling et al. ..... 704/201
2008/0126086 A1 * 5/2008 Vos et al. ..... 704/225

FOREIGN PATENT DOCUMENTS

DE 69833749 T2 8/2006

* cited by examiner

*Primary Examiner* — Yuwen Pan
*Assistant Examiner* — Phan Le
(74) *Attorney, Agent, or Firm* — Laurence A. Greenberg; Werner H. Stemer; Ralph E. Locher

(57) ABSTRACT

The circuit complexity or the filter order, respectively, of an analysis/synthesis filter bank system especially for hearing aids is to be reduced. For this reason, the stop-band attenuation of at least one of the transfer functions of the analysis filter bank is composed of a separately configurable, frequency-independent analysis basic attenuation component and a separately configurable frequency-dependent analysis attenuation component. Furthermore, the stop-band attenuation of at least one of the transfer functions of the synthesis filter bank is composed of a separately configurable, frequency-independent synthesis basic attenuation component, a separately configurable, frequency-dependent first synthesis attenuation component and a separately configurable, frequency-dependent second synthesis attenuation component which is also dependent on the manipulation of the sub-band signals. As a result, the stop-band attenuation can be reduced in dependence on frequency and the filter order can be correspondingly reduced.

9 Claims, 3 Drawing Sheets

FILTER BANK SYSTEM HAVING SPECIFIC STOP-BAND ATTENUATION COMPONENTS FOR A HEARING AID

CROSS-REFERENCE TO RELATED APPLICATION

This application claims the priority, under 35 U.S.C. §119, of German application DE 10 2008 058 496.7, filed Nov. 21, 2008; the prior application is herewith incorporated by reference in its entirety.

BACKGROUND OF THE INVENTION

Field of the Invention:

The present invention relates to a filter bank system for a hearing aid, having an analysis filter bank for splitting an input signal into sub-band signals, a processing device for manipulating at least one of the sub-band signals and a synthesis filter bank for combining the manipulated sub-band signal with at least one further sub-band signal. In addition, the present invention relates to a hearing device having such a filter bank system. The term "hearing aid" is here understood to be any sound-emitting device which can be worn in or on one's ear or on one's head, especially a hearing aid, a headset, headphones and the like.

Hearing devices are portable hearing aids which are used for supplying those hard of hearing. To accommodate the numerous individual needs, different designs of hearing devices such as behind-the-ear hearing devices (BTE), hearing device with external receiver (RIC—receiver in the canal) and in-the-ear hearing devices (ITE), e.g. also concha hearing aids or canal hearing aids (ITE, CIC—completely in the canal) are provided. The hearing aids listed by way of example are worn on the outer ear or in the auditory canal. In addition, however, bone conduction hearing aids, implantable or vibrotactile hearing aids are also available on the market. The damaged hearing is here stimulated either mechanically or electrically.

In principle, hearing devices have as primarily important components an input transducer, an amplifier and an output transducer. As a rule, the input transducer is a sound receiver, e.g. a microphone, and/or an electromagnetic receiver, e.g. an induction coil. The output transducer is in most cases implemented as electro-acoustic transducer, e.g. miniature loudspeaker, or as an electromechanical transducer, e.g. bone-conduction receiver. The amplifier is usually integrated into a signal processing unit. This basic configuration is shown in FIG. 1 with reference to a behind-the-ear hearing device. One or more microphones 2 for picking up the sound from the environment are built into a hearing device housing 1 to be worn behind the ear. A signal processing unit 3 which is also integrated into the hearing device housing 1 processes the microphone signals and amplifies them. The output signal of the signal processing unit 3 is transmitted to a loudspeaker or earpiece 4 which outputs an acoustic signal. If necessary, the sound is transferred to the eardrum of the wearer of the device via a sound tube which is fixed in the auditory canal by means of an ear mold. The hearing device and especially the signal processing unit 3 are supplied with energy by a battery 5, which is also integrated in the hearing device housing 1.

Sound signals which are picked up by one or more microphones of a hearing device or another hearing aid, respectively, are usually split into sub-band signals for further processing. For this purpose, an analysis/synthesis filter bank system is normally used. The filter bank system has one or more frequency-selective digital analysis filter banks (AFB) by means of which the sound signal is split into K>1 sub-band signals. This is followed by a sub-band-specific signal manipulation, especially an amplification or attenuation, respectively of the sub-band signals. Following this, the manipulated sub-band signals are resynthesized by way of one or more digital synthesis filter banks (SFB). As a rule, the filter bank system is an oversampling system and has an oversampling factor of $U \geqq 1$.

High-quality filter banks in hearing devices are subject to certain requirements. Thus, for example, a channel width of at least about 250 Hz is needed in the lowest bands. For the rest, the band gap should approximately follow the Bark scale. However, a finer resolution, for example in the wider bands of the Bark scale, is not in conflict with the application. Furthermore, a channel number of at least 22 is desirable. Depending on application (hearing damage of the patient), noise components due to aliasing and imaging should be below about 40-60 dB. Due to the intensive sub-band processing (especially the high required amplification for compensating for the hearing damage) in hearing devices, conventional methods for extinguishing aliasing and imaging are not effective. The filter banks must therefore be sampled "noncritically," in principle. Furthermore, the group delay (in each case for AFB and SFB) should be clearly below 5 ms and the group delay distortions should not exceed a certain limit. In this context, the group delay should be kept as low as possible, especially for high frequencies, which represents a considerable limiting factor for the filter bank.

The AFB and the SFB should especially be constructed in such a manner that the signal/noise ratio at the output of the filter bank system changes only within predeterminable limits with any manipulation (amplification/attenuation) of the sub-band signals. This also includes the case of complete independence of the signal/noise ratio at the output of the filter bank system of the manipulation of the sub-band signals.

In addition, the AFB and the SFB should be designed in such a manner that for a fluctuation of the signal/noise ratio permissible at the output of the filter bank system in dependence on the manipulation of the sub-band signals, the circuit complexity (corresponding to the filter orders) and/or the group delay (overall delay) of the filter bank system is reduced compared with the prior art.

In previous approaches for solving these problems, the AFB and SFB filter banks were designed, for example, to be equal (especially equal specification of amounts of AFB with minimum phase shift and SFB with maximum phase shift). In the case of the frequency-independent stop-band attenuation, the oversampling factor was not taken into consideration in detail. Just as little attention was paid to the signal manipulation in the system specification of the filter bank system. This resulted in great fluctuations of the signal quality (signal/noise ratio) in dependence on the respective manipulation (amplification) of the sub-band signals.

SUMMARY OF THE INVENTION

It is accordingly an object of the invention to provide a filter bank system which overcome the above-mentioned disadvantages of the heretofore-known devices and methods of this general type and which provides for a filter bank system having a reduced mathematical complexity but with which a high signal quality, especially a particular signal/noise ratio, can be achieved, nevertheless.

With the foregoing and other objects in view there is provided, in accordance with the invention, a filter bank system for a hearing aid, comprising:

an analysis filter bank configured to receive an input signal and to split the input signal into sub-band signals;

a processing device for receiving and manipulating at least one of the sub-band signals to generate a manipulated sub-band signal; and a synthesis filter bank for combining the manipulated sub-band signal with at least one further sub-band signal.

According to the invention, one or both of the following features applies:

- a stop-band attenuation of at least one transfer function of said analysis filter bank is composed of:
  - a separately configurable, frequency-independent analysis basic attenuation component; and
  - a separately configurable, frequency-dependent analysis attenuation component; and/or
- a stop-band attenuation of at least one transfer function of said synthesis filter bank is composed of:
  - a separately configurable, frequency-independent synthesis basic attenuation component;
  - a separately configurable, frequency-dependent and manipulation-dependent first synthesis attenuation component; and
  - a separately configurable, frequency-dependent second synthesis attenuation component.

In other words, the objects of the invention are achieved by a filter bank system for a hearing aid having an analysis filter bank (AFB) for splitting an input signal into sub-band signals, a processing device for manipulating at least one of the sub-band signals and a synthesis filter bank (SFB) for combining the manipulated sub-band signal with at least one further sub-band signal, the stop-band attenuation of at least one of the transfer functions of the analysis filter bank (AFB) being composed of a separately configurable frequency-independent analysis analysis basic attenuation component and a separately configurable frequency-dependent analysis attenuation component, and/or the stop-band attenuation of at least one of the transfer functions of the synthesis filter bank (SFB) is composed of a separately configurable frequency-independent synthesis analysis basic attenuation component, a separately configurable frequency-dependent and manipulation-dependent first synthesis attenuation component and a separately configurable frequency-dependent second synthesis attenuation component.

It is thus advantageously possible to utilize certain effects in the stop-band attenuation and to keep the attenuation high only where it is necessary. This may make it possible to reduce the filter order distinctly.

All attenuation components are preferably configured by means of the signal/noise ratio at the output of the filter bank system. This provides the expert with a simple criterion for the design of the filter bank systems.

In a special embodiment, the analysis basic attenuation component depends on the down-sampling factor of the analysis filter bank. The basic attenuation can thus be specified to a minimum value.

In addition, a masking effect of human hearing can be taken into consideration in the frequency-dependent analysis attenuation component and/or synthesis attenuation component. This makes use of the fact that in sound perception, two components which are spectrally close together may mask one another wholly or partially. Noise components which are hidden by other components will thus no longer have to be attenuated to the full extent.

In a further embodiment, the frequency-dependent analysis attenuation component can be periodically modified, the periodicity being determined by the oversampling factor of the analysis filter bank (AFB) and the maximum reduction in attenuation being determined by the pass-bands (transfer characteristic) of the AFB and SFB. In the same manner, the frequency-dependent synthesis attenuation component can be modified periodically, the periodicity being determined here, too, by the up-sampling factor or integration factor of the synthesis filter bank and the maximum decrease in attenuation being determined by the oversampling factor. The periodicity of the attenuation components takes into account the fact that the artifacts due to aliasing and imaging also occur periodically.

Similarly, the synthesis basic attenuation component can depend on the up-sampling factor of the synthesis filter bank.

Furthermore, it is of special advantage if the frequency-dependent first synthesis attenuation component depends on an amplification of the processing device. This makes it possible to select the attenuation of the noise components precisely such that they are greatly attenuated only if they are also high due to a high amplification of the useful signal. By this means, too, the filter complexity can be reduced generally or temporarily, respectively.

Furthermore, it is advantageous if the frequency-dependent second synthesis attenuation component is modified periodically, the periodicity being determined by the oversampling factor of the synthesis filter bank (SFB) and the maximum reduction in attenuation being determined by the pass-band (transfer characteristic) of the SFB.

It has already been indicated that the filter bank system described above can be used especially advantageously in a hearing device.

Other features which are considered as characteristic for the invention are set forth in the appended claims.

Although the invention is illustrated and described herein as embodied in a filter bank system having specific stop-band attenuation components for a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
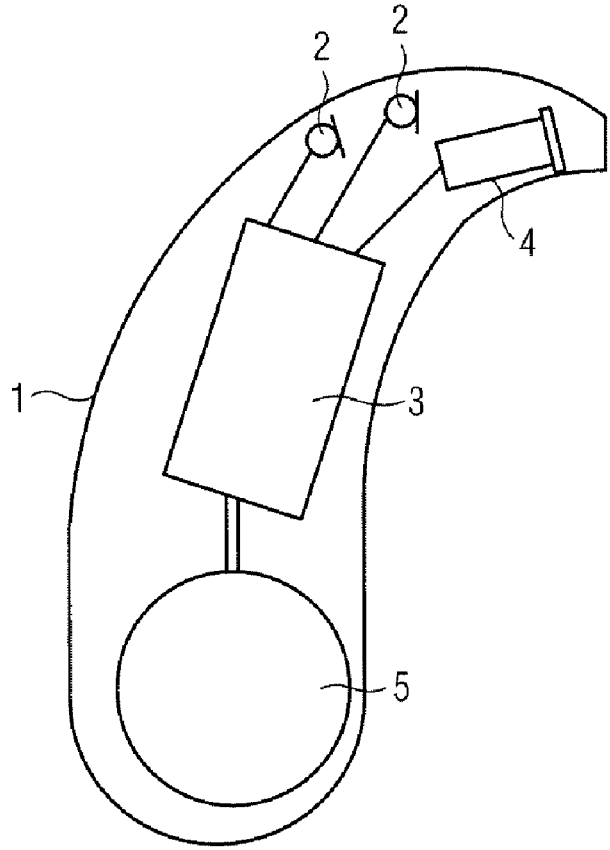
FIG. 1 PRIOR ART
FIG. 1 shows a basic sketch of a hearing device according to the prior art.
Figure 2:
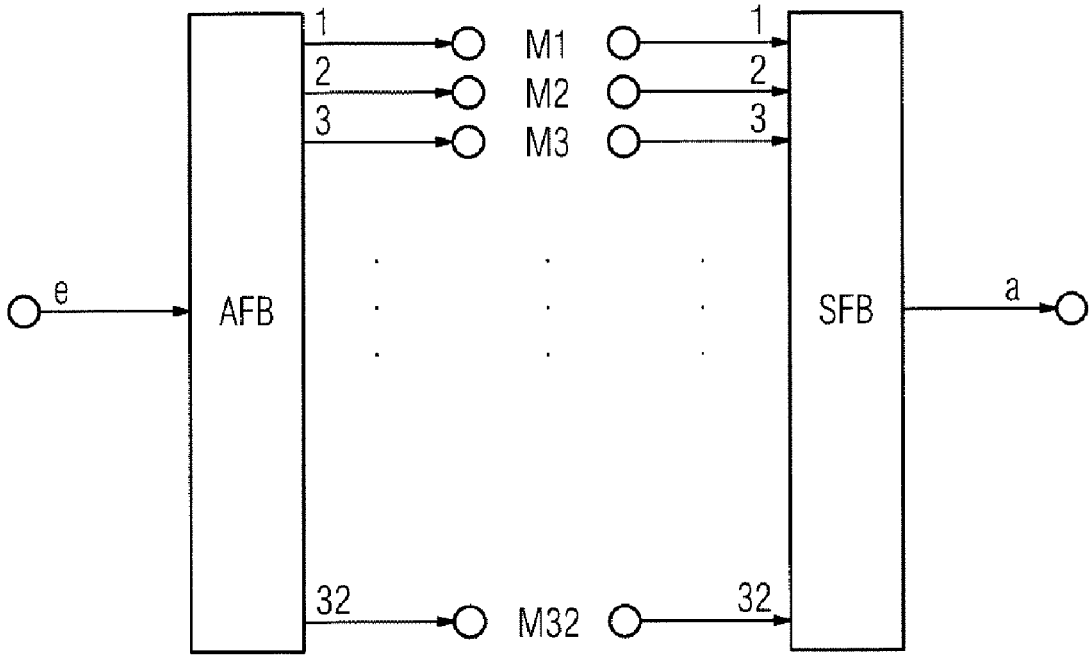
FIG. 2 is a block diagram of a filter bank system.

Referring now to the figures of the drawing relating to the invention in detail and first, particularly, to FIG. 2 thereof, there is shown a diagrammatic view of a filter bank system as is used, for example, in a device. An input signal e (e.g. voice signal) is supplied to an analysis filter bank AFB. The latter splits the input signal e into 32 sub-bands. This is followed by a sub-band-specific manipulation M1, M2, M3, . . . , M32 of the individual signals. After the manipulation, the individual sub-band signals are synthesized again to form an output signal a in a synthesis filter bank SFB adapted to the analysis filter bank AFB with regard to the absolute frequency response.

Both in the analysis filter bank AFB and in the synthesis filter bank SFB, the individual filter functions are implemented by so-called prototype filters from which the individual filters are derived, for example by a complex-modulating transformation core in the filter bank. These prototype filters have, for example, a low-pass characteristic. In the text which follows, only the stop-band of the prototype filters will be considered.

In accordance with the core concept according to the invention, the stop-band attenuation specification of the transfer functions of the AFB is composed of a frequency-independent basic attenuation $a^{AFB}$ and frequency-dependent attenuation components. The stop-band attenuation specification of the transfer functions of the SFB is composed of a frequency-independent basic attenuation $a^{SFB}$ and first and second frequency-dependent attenuation components, the first frequency-dependent attenuation component additionally depending on the signal manipulation between the two filter banks. In particular, the AFB and the SFB should be specified in such a manner that, by utilizing the oversampling of the sub-band signals by a factor U >1 (U=oversampling factor), the circuit complexity, i.e. the filter order and/or the overall group delay (delay) of the filter bank system is reduced. In addition, reciprocal masking effects of signal components closely adjacent in frequency should also be used as an option in order to reduce the circuit complexity or the filter order and/or the overall group delay of the filter bank system. Furthermore, the deterioration of the signal/noise ratio at the output of the filter bank system should be approximately equally large with any manipulation (amplification/attenuation of the sub-band signals by aliasing contributions of the AFB or by imaging contributions of the SFB.

Figure 3:
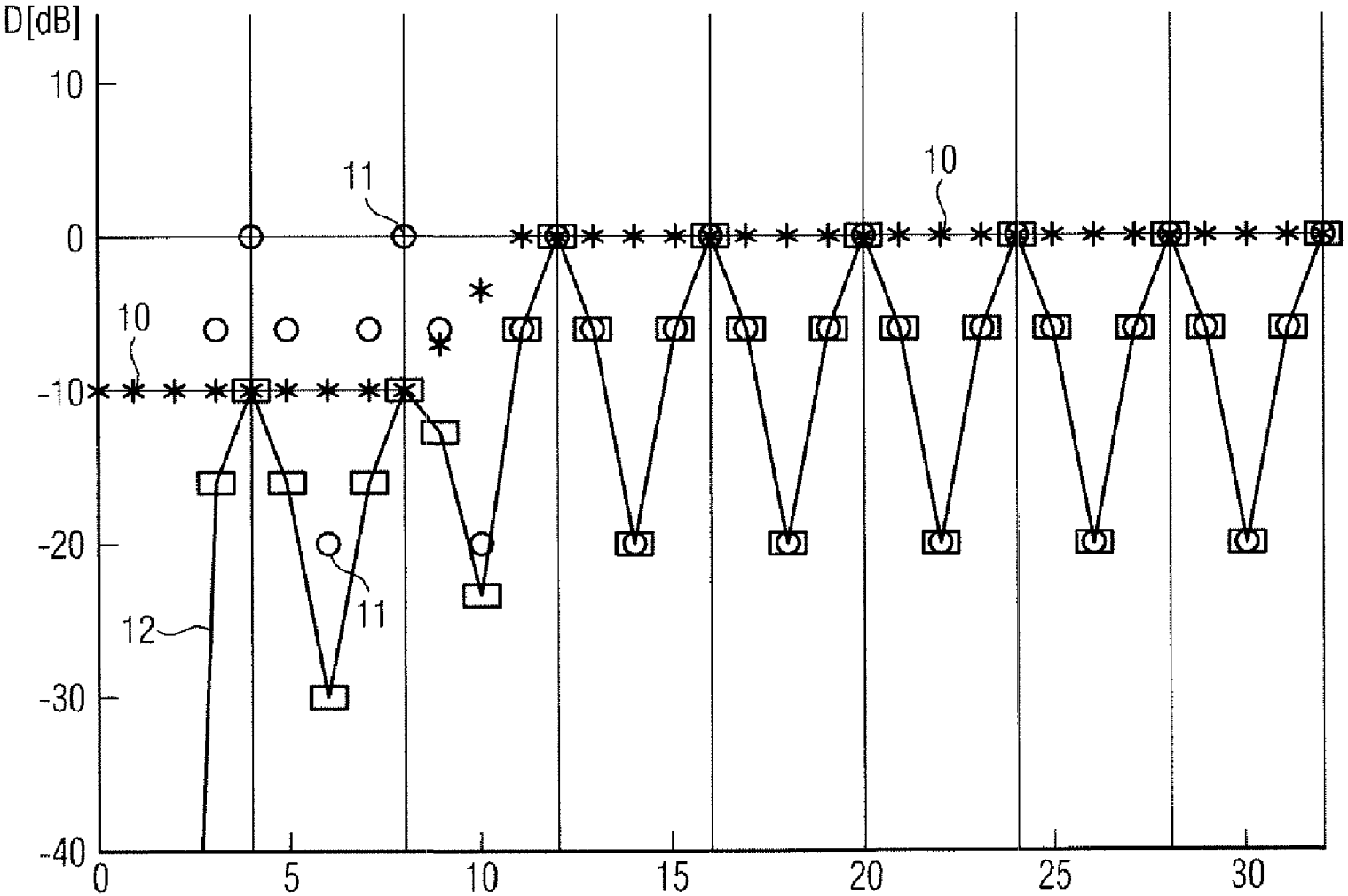
FIG. 3 is a graph showing an example of the specification of an AFB prototype filter.
Figure 4:
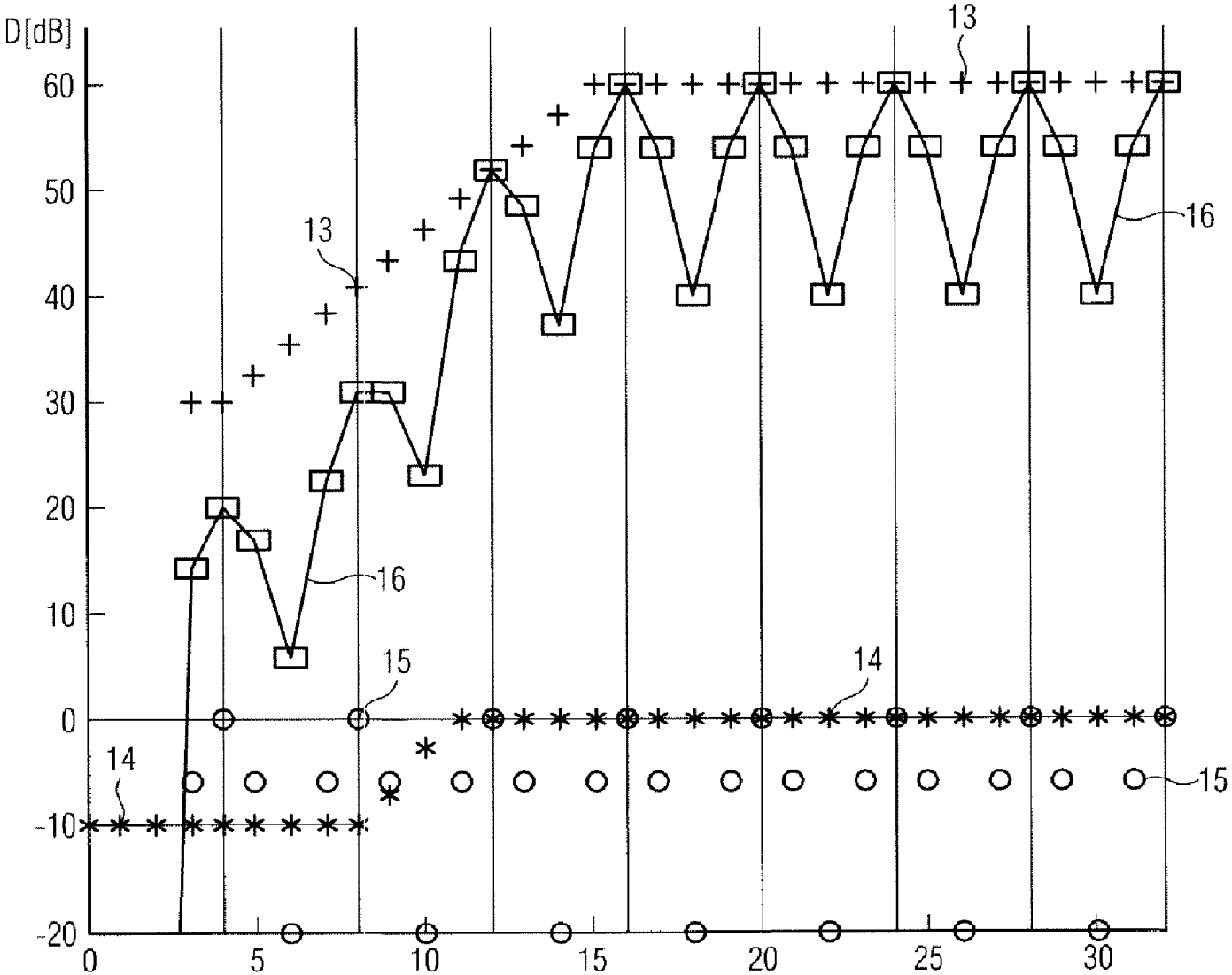
FIG. 4 is a graph showing an example of the specification of an SFB prototype filter.

The configuration of an actual filter bank system will now be explained in greater detail with reference to FIGS. 3 and 4. In general, the signal/noise ratio SNR at the output of the filter bank system is used as an objective criterion for the dimensioning of the filters.

In the configuration of the analysis filter bank AFB, a frequency-independent basic attenuation $a^{AFB}$ is first specified by the desired $SNR^{AFB}$. This signal/noise ratio $SNR^{AFB}$ is obtained due to aliasing in the AFB. In this context, the basic attenuation $a^{AFB}$ is dependent on the decimation factor M (=down-sampling factor) of the AFB which determines the number of aliasing components that are present at all. The basic attenuation in the stop-band is now supplemented by a frequency-dependent additional stop-band attenuation. A first part 10 of the frequency-dependent attenuation component of the AFB specification is obtained by the fact that masking effects of the human ear are utilized. This reduces the stop-band attenuation in the vicinity of the filter pass-band. In the example of FIG. 3, this second part 10 is reduced by 10 dB in the vicinity of the pass-band and then increases ramp-like to its final value from the eighth sub-band onwards.

A second part 11 of the frequency-dependent attenuation component of the AFB specification is obtained by the fact that the noise components generated by aliasing in the AFB are weighted differently in the SFB. The second part 11 is periodic so that the entire stop-band attenuation is periodically modified over the frequency. In this context, the number of periods depends on the oversampling factor U and the depth of the permissible decrease in attenuation is determined by the product of the pass-bands of the prototype filters in the AFB and SFB.

The entire stop-band attenuation 12 is obtained from the sum of all attenuation components including the basic attenuation, using a logarithmic measure (decibels) as a basis. FIG. 3 shows the entire frequency-dependent stop-band attenuation 12. Its absolute level is obtained from the basic attenuation $a^{AFB}$ (not shown in FIG. 3) which is added logarithmically to the frequency-dependent stop-band attenuation. The frequency-dependent stop-band attenuation thus increases in accordance with the ramp of the first part 10 over the 32 sub-bands selected here.

The basic attenuation $a^{SFB}$ of the synthesis filter bank is also specified by the desired signal noise ratio $SNR^{SFB}$. It is obtained on the basis of imaging in the SFB. Here, too, the basic attenuation $a^{SFB}$ is dependent on the interpolation factor M of the SFB which is equal to the decimation factor M of the AFB.

A first frequency-dependent attenuation component 13 increases the basic attenuation $a^{SFB}$ of the stop-band attenuation specification by the frequency-dependent amplification (attenuation=negative amplification in dB) with which the sub-band signals are manipulated between the filter banks. This amplification-dependent component is important because the imaging components in the SFB are also amplified.

As in the AFB, a first part 14 of the second frequency-dependent attenuation component of the SFB specification (compare FIG. 4) is obtained by utilizing masking effects of the human ear. The specification of the stop-band attenuation of the transfer function of the SFB filters is thus reduced in the vicinity of the filter pass-band exactly as in the AFB. This reduction can also contribute to a reduction in the filter order.

Furthermore, a second part 15 of the second frequency-dependent attenuation component of the SFB specification is obtained by the fact that U·(M-1) spectral components (images of the SFB) of different intensity come to lie in each channel. In one channel, M-1 main components (central band of a spectral distribution of signal and aliasing power) and K-M-1 secondary components attenuated to different degrees (outer bands of the spectral distribution of signal and aliasing power) are obtained. In consequence, the specification of the stop-band attenuation is modified periodically over the frequency, the number of periods depending on the oversampling factor U and the depth of the permissible decrease in attenuation being determined by the pass-band of the prototype filter (in the SFB).

The entire stop-band attenuation 16 of the prototype filter for the SFB is again obtained from the sum of all attenuation components. Here, too, the basic attenuation $a^{SFB}$ determines the absolute position of the stop-band attenuation in that it is added logarithmically to the frequency-dependent attenuation components for the specification of the prototype filter.

The frequency-dependent reduction in stop-band attenuation 12 and 16 in the optimized specifications (compare FIGS. 3 and 4) is then utilized for reducing, for example, the circuit complexity or the filter order, respectively. As an alternative, additionally or implicitly (for the case of a fixed relationship between filter order and group delay given with a given filter type), the frequency-dependent reduction in stop-band attenuation can also be utilized for reducing the group delay. Optionally, the frequency-independent basic attenuation of the filter banks can also be increased if the stop-band attenuation can be reduced in dependence on frequency. These advantages can be utilized in dependence on frequency. These advantages can be utilized individually or in combination.

The invention claimed is:

1. A filter bank system for a hearing aid, comprising:
an analysis filter bank configured to receive an input signal and to split the input signal into sub-band signals;
a processing device for receiving and manipulating at least one of the sub-band signals to generate a manipulated sub-band signal; and
a synthesis filter bank for combining the manipulated sub-band signal with at least one further sub-band signal;
wherein one or both of the following is true:
a stop-band attenuation of at least one transfer function of said analysis filter bank is composed of:
a separately configurable, frequency-independent analysis basic attenuation component; and
a separately configurable, frequency-dependent analysis attenuation component; and/or
a stop-band attenuation of at least one transfer function of said synthesis filter bank is composed of:
a separately configurable, frequency-independent synthesis basic attenuation component;
a separately configurable, frequency-dependent and manipulation-dependent first synthesis attenuation component; and
a separately configurable, frequency-dependent second synthesis attenuation component.

2. The filter bank system according to claim 1, wherein each of said attenuation components is configured by way of a signal/noise ratio at an output of the filter bank system.

3. The filter bank system according to claim 1, wherein the analysis basic attenuation component depends on a down-sampling factor of said analysis filter bank.

4. The filter bank system according to claim 1, wherein a masking effect of human hearing is taken into consideration in one or both of the frequency-dependent analysis attenuation component and the second synthesis attenuation component.

5. The filter bank system according to claim 1, wherein the frequency-dependent analysis attenuation component is a periodically modified attenuation component, a modification periodicity being determined by an oversampling factor of said analysis filter bank and a maximum reduction in attenuation being determined by the pass-bands of said analysis filter bank.

6. The filter bank system according to claim 1, wherein the synthesis basic attenuation component depends on an up-sampling factor of said synthesis filter bank.

7. The filter bank system according to claim 1, wherein the frequency-dependent first synthesis attenuation component depends on an amplification of said processing device.

8. The filter bank system according to claim 1, wherein the frequency-dependent second synthesis attenuation component is a periodically modified attenuation component, a modification periodicity being determined by an oversampling factor of said synthesis filter bank and a maximum reduction in attenuation being determined by a pass-band of said synthesis filter bank.

9. A hearing device, comprising a filter bank system according to claim 1.

* * * * *